US006783033B1

(12) United States Patent
Chan

(10) Patent No.: US 6,783,033 B1
(45) Date of Patent: Aug. 31, 2004

(54) DISPENSER FOR MAGNETIC OBJECTS

(75) Inventor: Sik-Leung Chan, New Territories (CN)

(73) Assignee: C. C. & L Company Limited, Tsuen Wan (HK)

( * ) Notice: Subject to any disclaimer, the term of this patent is extended or adjusted under 35 U.S.C. 154(b) by 51 days.

(21) Appl. No.: 10/287,381

(22) Filed: Nov. 4, 2002

(51) Int. Cl.[7] ..... B67D 5/64

(52) U.S. Cl. ..... 222/166; 222/167; 222/185.1; 206/340; 206/350; 206/818; 221/212; 221/277

(58) Field of Search ..... 222/166–167, 222/160, 181.1, 185.1; 206/338, 340, 350, 818; 221/195, 265, 212, 277, 190

(56) References Cited

U.S. PATENT DOCUMENTS 3,750,868 A * 8/1973 Cooper ..... 206/338
4,047,637 A * 9/1977 Grunstad et al. ..... 221/265
4,058,209 A * 11/1977 Schmidt ..... 206/350
5,078,300 A * 1/1992 Heu ..... 221/212
5,096,091 A * 3/1992 Heu ..... 221/212
5,097,947 A * 3/1992 Hsu ..... 206/214
5,205,407 A * 4/1993 Tu ..... 206/338
5,520,307 A * 5/1996 Miller et al. ..... 221/2

* cited by examiner

*Primary Examiner*—David A. Scherbel
*Assistant Examiner*—Frederick C. Nicolas
(74) *Attorney, Agent, or Firm*—Alix, Yale & Ristas, LLP

(57) ABSTRACT

A dispenser for magnetic objects includes a base having a curved rack. A barrel is attached to the base and has an opening with a magnet adjacent to it for retaining paperclips or other magnetic objects in an easy-access position. The barrel is mounted on a pivot arm and has a pinion attached to its side that co-operates with the rack upon pivotal movement of the pivot arm relative to the base so that the barrel rotates to an inverted orientation. The invention is particularly useful when the barrel becomes almost empty of paperclips. Pivotal inversion of the barrel allows remaining clips to fall toward the opening to be retained by the magnet.

4 Claims, 7 Drawing Sheets

DISPENSER FOR MAGNETIC OBJECTS

BACKGROUND OF THE INVENTION

The present invention relates to dispenser for magnetic objects. More particularly, although not exclusively, the invention relates to a dispenser having a receptacle with an opening surrounded by a magnetic ring. The dispenser can be inverted by mechanical means to enable paperclips or other magnetic objects at the bottom of the receptacle to be presented and retained magnetically at the opening for easy access.

Known paperclip dispensers comprise a receptacle having a lid incorporating an aperture surrounded by a magnet. When the receptacle is substantially full of clips, the magnet has sufficient strength to retain some of clips at the aperture for easy access. However, the magnets display insufficient strength to attract clips from the bottom of the receptacle when the receptacle is near-empty. Therefore the dispenser must be raised manually and inverted so that the clips fall toward the magnet and are retained at the opening prior to inversion to the original orientation.

OBJECTS OF THE INVENTION

It is an object of the present invention to overcome or substantially ameliorate the above disadvantage and/or more generally to provide improved dispenser for magnetic objects.

DISCLOSURE OF THE INVENTION

There is disclosed herein a dispenser for magnetic objects comprising:

a base, an engaging surface on the base, a barrel attached to the base and comprising an opening having a magnet adjacent thereto, the barrel having an engager fixed thereto, the engager adapted to co-operate with the engaging surface upon movement of the barrel relative to the base so that the barrel rotates to an inverted orientation.

Preferably the engaging surface comprises a rack.

Preferably the engager comprises a pinion.

Preferably the pinion can move beyond one or either end of the rack to disengage therefrom to allow the barrel to spin freely.

Preferably the barrel is attached pivotally to the base and the rack is curved. Preferably a pivot arm extends between the base and the barrel such that upon pivotal movement of the arm, the barrel rotates due to engagement of the pinion with the rack.

Preferably the device further comprises a drum fixed to the barrel and having an annular array of inwardly facing teeth engaging with ratchet arms extending from a hub that rotates with the pinion, allowing rotation of the barrel with respect to the pinion in one direction only.

Preferably there is a weight in the barrel to ensure that the opening is presented in a desired orientation when the pinion has moved beyond either end of the rack.

DEFINITIONS

As used herein, the word "barrel" is intended to mean a receptacle having an opening. Moreover, a "barrel" is not necessarily traditionally barrel-shaped, but might be generally spherical, cubed or any other shape.

As used herein, the word "magnetic" means "attracted by a magnet".

BRIEF DESCRIPTION OF THE DRAWINGS

A preferred form of the present invention will now be described by way of example with reference to the accompanying drawings, wherein.

DESCRIPTION OF THE PREFERRED EMBODIMENT

Figure 1:
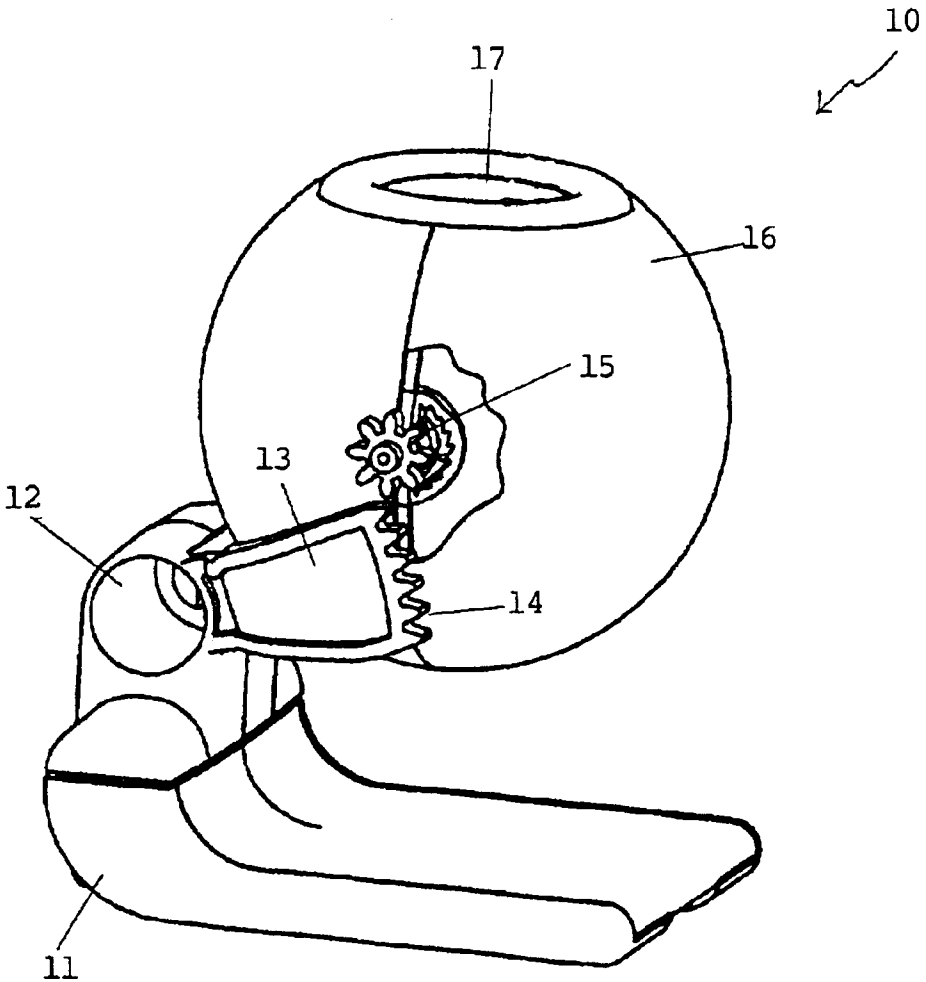
FIG. 1 is a schematic perspective illustration of parts of a dispenser for paperclips having its barrel in a dispensing orientation.
Figure 2:
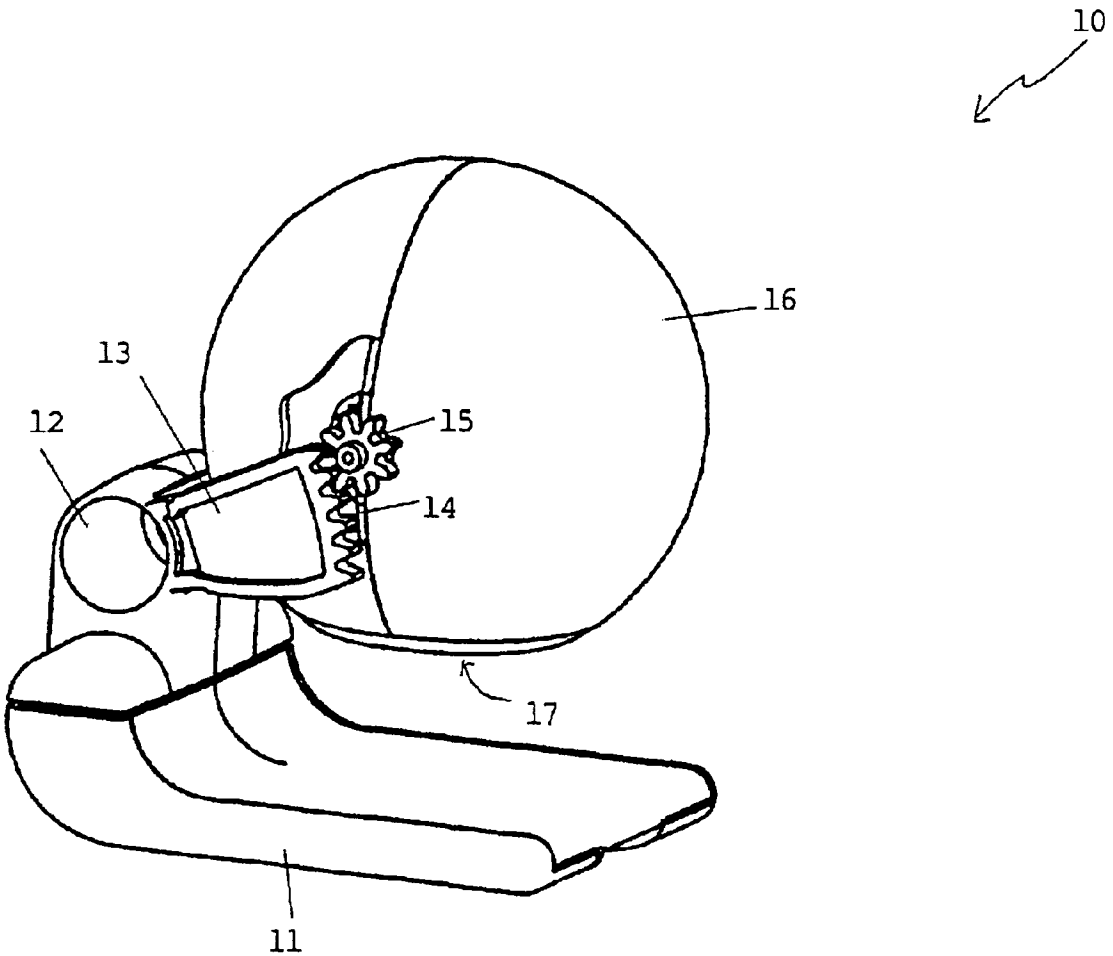
FIG. 2 is a schematic perspective illustration similar to FIG. 1, but showing the barrel in an inverted orientation.
Figure 3:
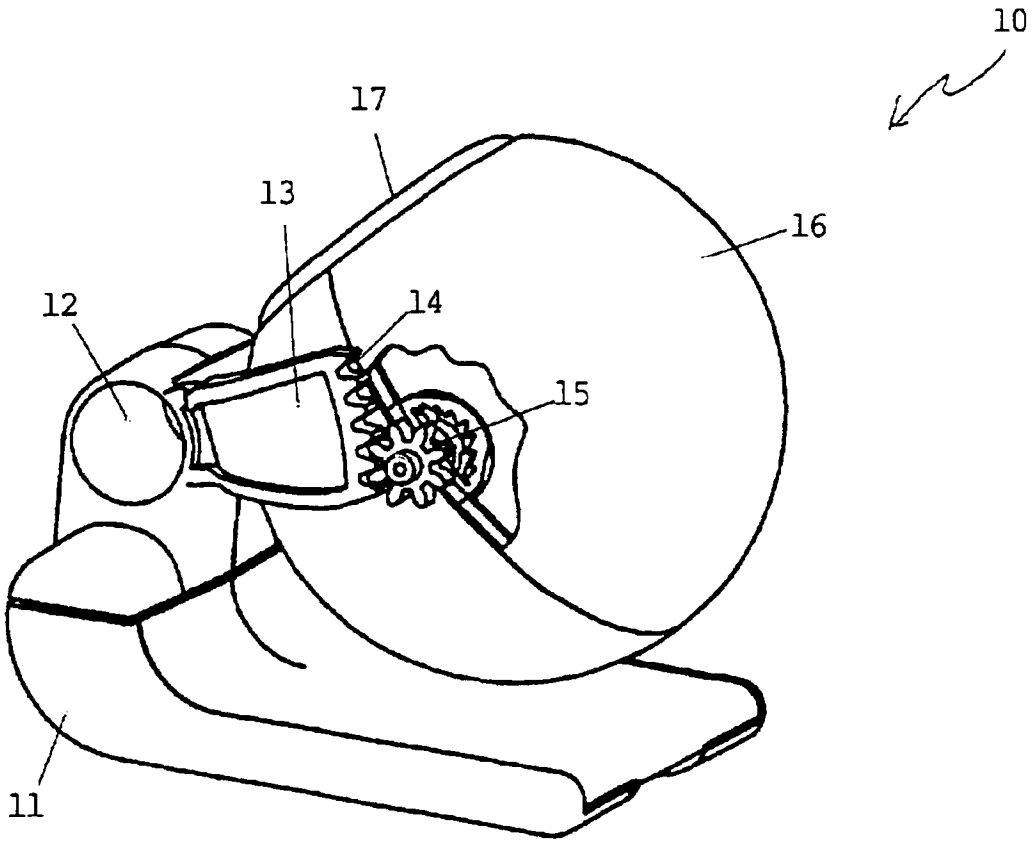
FIG. 3 is a schematic perspective illustration similar to FIGS. 1 and 2, showing the barrel in and overshoot configuration.

In the accompanying drawings there is depicted schematically a paperclip dispenser 10. It should be appreciated however that the dispenser might be adapted in size and shape to dispense other magnetic objects such as pins, tacks, nails and screws for example. The dispenser 10 is typically fabricated from moulded plastics parts and includes a base 11 having positioned thereon a hinge mount 12. A fixed arm 13 extends from the hinge mount 12 and includes a curved rack 14 at its distal end. Mounted pivotally to the hinge mount 12 by parts not depicted in FIGS. 1 to 3, is a barrel 16 having an upper opening 17. There is a pinion 15 fixed with respect to the barrel 16 and projecting from one of its sides.

Figure 4:
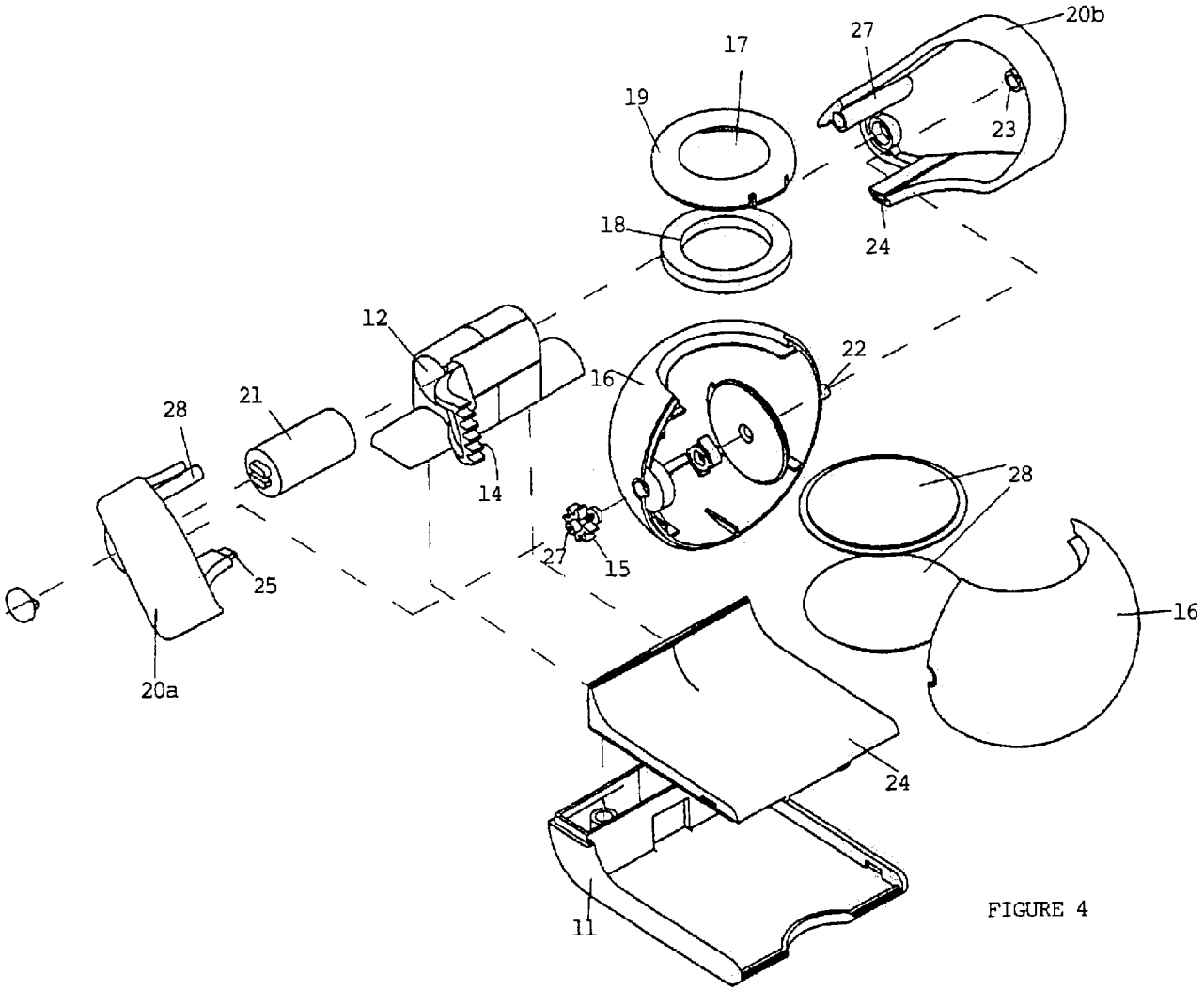
FIG. 4 is a schematic parts-exploded perspective view of a paperclip dispenser.
Figure 5:
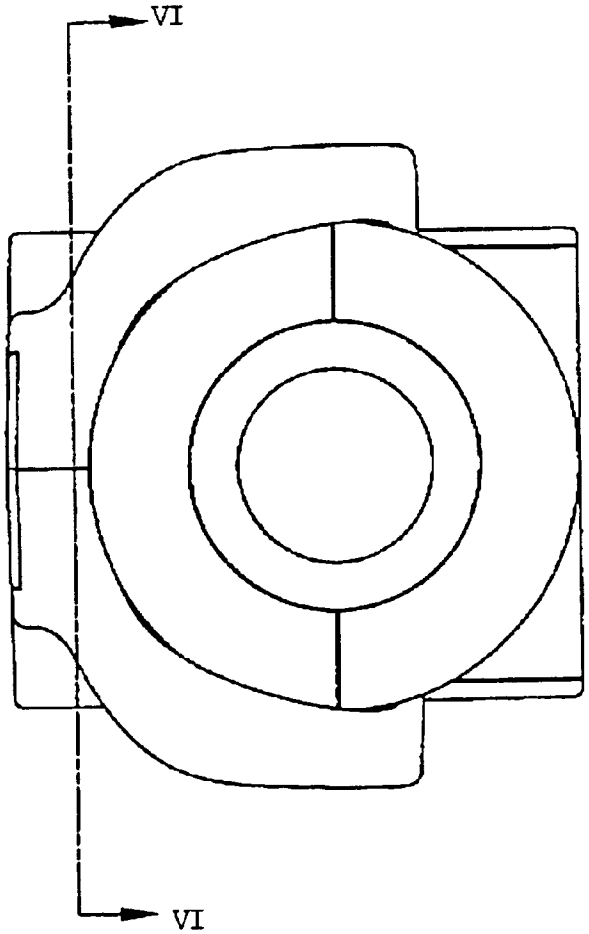
FIG. 5 is a schematic plan view of the paperclip dispenser.
Figure 6:
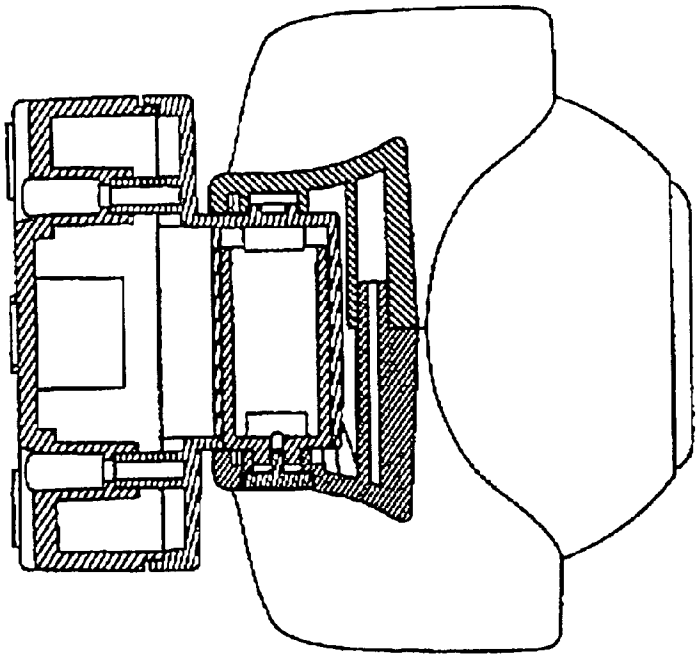
FIG. 6 is a schematic cross-sectional elevational view of the paperclip dispenser taken and VI—VI in FIG. 5.
Figure 8:
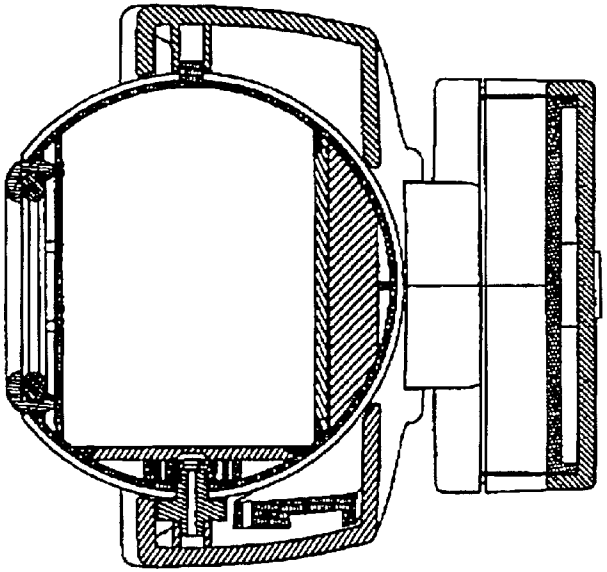
FIG. 8 is a schematic cross-sectional elevational view of the paperclip dispenser taken at VIII—VIII in FIG. 7.
Figure 7:
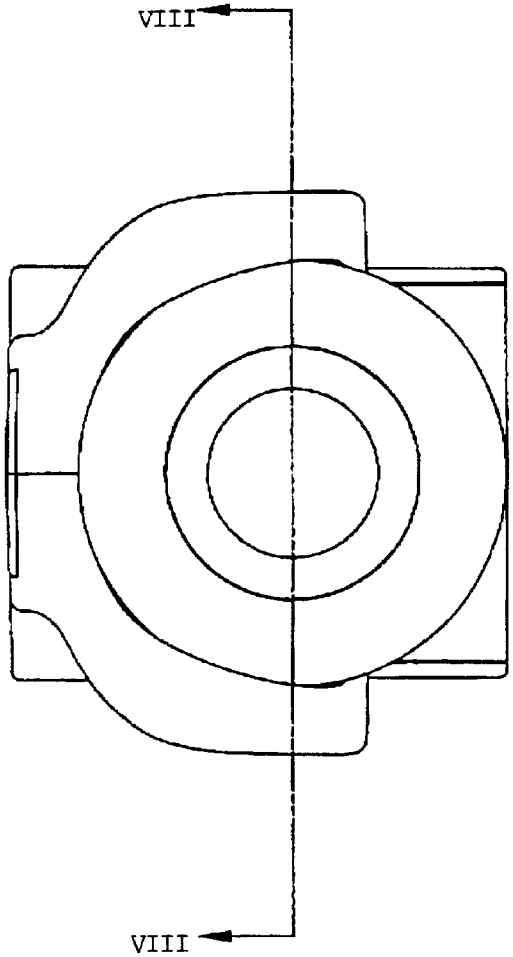
FIG. 7 is another schematic plan view of the paperclip dispenser.

At the opening 17 as shown in FIG. 4 there is a cover 19 beneath which there is located a magnetic ring 18. An axle 21 fits within the hinge mount 12. Respective pivot arm halves are attached pivotally to either end of the axle. The arm halves are secured to one another by means of a tab 25 that fits into a slot as shown. Adhesive or snap-engagement might be employed. Also, a screw can extend through a screw tube 27 into a pre-tapped aperture in a corresponding screw tube 28. The arms 20*a* and 20*b* cradle the barrel 16 by partly surrounding it. On the inside surface of each arm half, there is a pivot hole 23, one of which receives a pivot pin 22 and the other (not shown in FIG. 4) of which receives a shaft 27 formed integrally with the pinion 15. That is, the arm halves 20*a* and 20*b* support the barrel 16 at its transverse central axis.

There is a spring (not shown) at the hinge to bias the arm halves 20*a* and 20*b* into an upper, rest position wherein the pinion 15 is out of engagement with the rack 14 as shown in FIG. 1. The spring could be a coil spring or a leaf spring for example.

Figure 9:
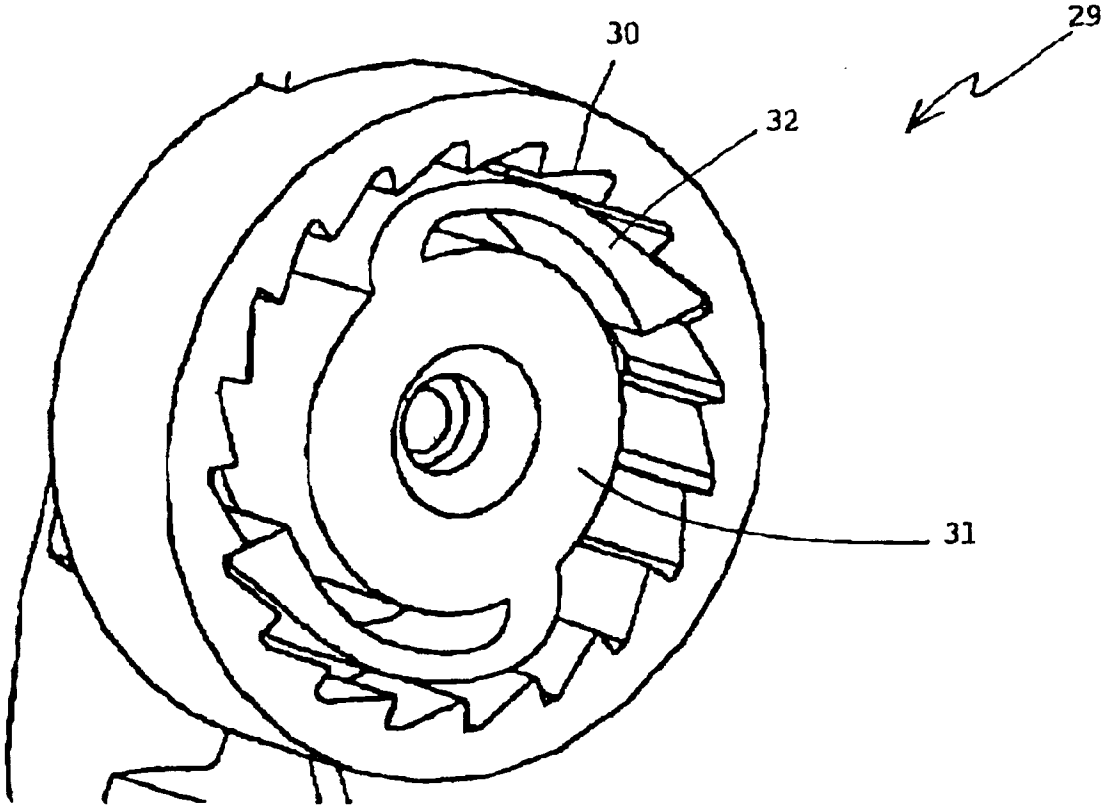
FIG. 9 is a schematic perspective illustration of a ratchet mechanism incorporated into the dispenser.

Situated adjacent to the pinion 15 is a ratchet mechanism 29 (shown in FIG. 3, and in more detail in FIG. 9). The mechanism 29 includes a drum fixed with respect to the barrel 16 and having an inwardly facing annular array of sprocket teeth 30. A central hub 31 is fixed to rotate with the pinion 15 and has a pair of diametrically opposed resilient ratchet arms 32, the tips of which engage with the sprocket teeth 30 so that the hub can rotate relative to the drum of sprocket teeth in one direction only.

Upon the application of downward force to the distal end of either or both arm half 20*a* or 20*b*, the barrel 16 and pinion 15 pivot downwardly and the teeth of pinion 15 engage with the teeth of the curved rack 14 as shown in FIG. 2. This results in rotation of the barrel 16 to an inverted orientation. During this downward movement, the ratchets 32 simply ride over the sprocket teeth 30. The inverted orientation can be over-shot as shown in FIG. 3, and further downward movement of the barrel will result in the,pinion 15 passing the bottom end of the rack 14. If downward movement is executed rapidly, this overshooting and disengagement of the pinion 15 from the rack 14 will result in over-spinning of the barrel to ensure that any paperclips therein a presented to the magnet. Once downward force on the arm halves is released, the spring will bias the arm halves upwardly to the position where the barrel 16 reverts to its dispensing orientation as shown in FIG. 1. The engagement of the tips of ratchets 32 with the sprocket teeth 30 will ensure rapid reverse rotation of the barrel 16 to the dispensing orientation.

If, instead of applying downward force to the ends of the arms 20*a* and 20*b*, the user presses directly upon the barrel 16, the interaction of the ratchet arms 32 with the sprocket teeth 30 will ensure that the barrel does not spin away from under the user's fingers. That is, rotation of the hub with respect to the drum is prevented during downward pivotal movement of the arms until force is released from the barrel 16. The return spring then acts to return the barrel to be raised position, during which movement the barrel rotates by interaction of the ratchet arms with the sprocket teeth as described earlier.

The barrel can have a weight in its bottom such as that shown at 28 in FIG. 4 to ensure that when the pinion 15 disengages the rack 14, the opening 17 is presented upwardly. As an alternative, the opening 17 might be presented to the front, in which case the weight would be situated in one side of the barrel.

It should be appreciated that modifications and alterations obvious to those skilled in the art are not to be considered as beyond the scope of the present invention. For example, instead of providing a spring to return the arm halves to the upper position, magnetic means could be provided for achieving the same result. Furthermore, instead of providing a rack and pinion arrangement, a gripping surface and wheel arrangement could be provided. Furthermore, instead of providing a drum with inwardly facing sprocket teeth surrounding a boss with outwardly extending ratchet arms, there might be outwardly facing sprocket teeth on a central hub and ratchet arms extending inwardly from the drum to engage with the teeth.

What is claimed is:

1. A dispenser for magnetic objects comprising:

a base;

an engaging surface comprising a toothed rack on the base;

a barrel attached to the base and comprising an opening having a magnet adjacent thereto, the barrel having an engager fixed thereto, the engager adapted to co-operate with the engaging surface upon movement of the barrel relative to the base so that the barrel rotates to an inverted orientation; and a pivot arm extending between the base and the barrel such that upon pivotal movement of the arm, the barrel rotates due to engagement of a pinion with the rack.

2. The dispenser of claim 1 wherein the barrel is attached pivotally to the base and the rack is curved.

3. A dispenser for magnetic objects comprising:

a base;

an engaging surface on the base;

a barrel attached to the base and comprising an opening having a magnet adjacent thereto the barrel having an engager fixed thereto, the engager adapted to co-operate with the engaging surface upon movement of the barrel relative to the base so that the barrel rotates to an inverted orientation; and a drum fixed to the barrel and having an annular array of inwardly facing teeth engaging with ratchet arms extending from a hub that rotates with a pinion, allowing rotation of the barrel with respect to the pinion in one direction only.

4. A dispenser for magnetic objects comprising:

a base;

an engaging surface comprising a toothed rack on the base;

a barrel attached to the base and comprising an opening having a magnet adjacent thereto, the barrel having an engager comprising a pinion fixed thereto, said pinion moveable beyond one of either end of the rack to disengage therefrom to allow the barrel to over-spin, the engager adapted to co-operate with the engaging surface upon movement of the barrel relative to the base so that the barrel rotates to an inverted orientation; and a weight in the barrel to ensure that the opening is presented in a desired orientation when the pinion has moved beyond either end of the rack.

* * * * *